US005079397A

United States Patent [19]

Keefer

[11] Patent Number: 5,079,397

[45] Date of Patent: Jan. 7, 1992

[54] SUSCEPTORS FOR MICROWAVE HEATING AND SYSTEMS AND METHODS OF USE

[75] Inventor: Richard M. Keefer, Peterborough, Canada

[73] Assignee: Alcan International Limited, Montreal, Canada

[21] Appl. No.: 271,664

[22] Filed: Nov. 15, 1988

[30] Foreign Application Priority Data

Nov. 18, 1987 [CA] Canada ..... 552110

[51] Int. Cl.[5] ..... H05B 6/80

[52] U.S. Cl. ..... 219/10.55 E; 219/10.55 F; 219/10.55 M; 426/107; 426/234; 426/243

[58] Field of Search ..... 219/10.55 E, 10.55 F, 219/10.55 M; 99/DIG. 14, 451; 426/107, 113, 109, 114, 241, 243, 234; 126/390

[56] References Cited

U.S. PATENT DOCUMENTS

| | | | |
|---|---|---|---|
| 3,302,632 | 2/1967 | Fichtner | 219/10.55 E |
| 4,184,061 | 1/1980 | Suzuki et al. | 219/10.55 E |
| 4,190,757 | 2/1980 | Turpin et al. | 219/10.55 E |
| 4,230,924 | 10/1980 | Brastad et al. | 219/10.55 E |
| 4,626,641 | 12/1986 | Brown | 219/10.55 E |
| 4,676,857 | 6/1987 | Scharr et al. | 426/107 X |
| 4,801,774 | 1/1989 | Hart | 219/10.55 E |
| 4,865,921 | 9/1989 | Hollenberg et al. | 219/10.55 E |
| 4,883,936 | 11/1989 | Maynard et al. | 219/10.55 F |
| 4,904,836 | 2/1990 | Turpin et al. | 219/10.55 E |
| 4,908,246 | 3/1990 | Fredricks et al. | 428/34.1 |

FOREIGN PATENT DOCUMENTS

| | | | |
|---|---|---|---|
| 246041 | 11/1987 | European Pat. Off. | 219/10.55 E |
| 1593523 | 7/1981 | United Kingdom . | |

OTHER PUBLICATIONS

Rice, "Microwave Susceptors Control Energy Absorption Rates", Food Processing, Jun. 1986.

*Primary Examiner*—Philip H. Leung
*Attorney, Agent, or Firm*—Cooper & Dunham

[57] ABSTRACT

A susceptor for use in the heating of a foodstuff or other material in a microwave oven is constructed to have at least two regions (12,14) which are each adapted to couple with and absorb microwave energy for the generation of heat in such regions, which heat is then radiatively and conductively transferred to the material. The invention is characterized by one such region (12) having a different lossiness from the other (14), the regions being contiguous with each other. They preferably have a stepwise discontinuity of lossiness between them, which causes higher order mode or modes of microwave energy to be generated or accentuated. The susceptor may be a separate panel or may be a wall component, e.g. the bottom, of a container or utensil, or a removable cover therfor.

29 Claims, 4 Drawing Sheets

SUSCEPTORS FOR MICROWAVE HEATING AND SYSTEMS AND METHODS OF USE

The present invention relates to susceptors characterised by a more even or modified distribution of heating when used in conjuction with a foodstuff or other material to be heated in a microwave oven. A susceptor is a structure that absorbs microwave energy, as distinct from structures which are transparent to or reflective of such energy.

According to the present invention, a susceptor may take the form of a panel which is adjacent to a body of material to be heated, or the form of a part of a container for the material, e.g. the bottom of the container, or a lid for the container, or the form of a reusable utensil such as a browning skillet or the like. Although the material to be heated or cooked will primarily be a foodstuff, the present invention is not limited to the heating or cooking of foodstuffs.

Conventional containers have smooth bottoms and sidewalls. When filled, they act as resonant devices and, as such, promote the propagation of a fundamental resonant mode of microwave energy. Microwave energy in the oven is coupled into the container holding the material via, for example, the top of the container, and propagates within the container. The energy of the microwaves is given up in the lossy material or foodstuff and converted to heat energy that heats or cooks the material or foodstuff. By and large, the boundary conditions of the body of material constrain the microwave energy to a fundamental mode. However, other modes may exist within the container but at amplitudes which contain very little energy. In typical containers, thermal imaging measurements have shown that the propagation of the microwave energy in the corresponding fundamental modes produces localized areas of high energy and therefore high heating, while at the same time producing areas of low energy and therefore low heating. In most bodies of material to be heated, high heating is observed in an annulus near the perimeter, with low energy heating in the central region. Such a pattern would strongly indicate fundamental mode propagation.

Another aspect of the prior art relevant to the present invention is that of susceptors per se, which have traditionally been made of lossy materials, i.e. materials that will absorb significant amounts of microwave energy and hence become heated. Such lossy materials have traditionally been embedded in the bottoms of reusable utensils to form browning pans and the like.

Such prior art susceptors have thus been designed to become heated themselves and then to convey heat to the food material by radiation, or by conduction or convection, rather than to modify the microwave energy absorption characteristics of the body of food.

However, problems have been experienced in the past in obtaining adequately uniform heating in such a susceptor and hence at a food surface.

The present invention seeks to provide improvements in this respect, in particular to provide a more even, or other desired, distribution of heating in a susceptor, and hence at an adjacent food (or other material) surface.

According to the invention there is provided a susceptor for use with a body of material to be heated in a microwave oven, said susceptor comprising a panel having at least two regions of a lossy substance, each such region being adapted to couple with and absorb microwave energy to generate heat, one such region having a different lossiness from the other such region and the regions being contiguous with each other whereby to provide a discontinuity of lossiness between them.

In this context, the term "lossiness" is used to refer to that property of the material of the susceptor region concerned whereby energy coupled into the susceptor regions is absorbed and heats the material. In other words, lossiness refers to the energy extracted from impinging microwave radiation, and dissipated as heat. The property of lossiness, in this context, causes a portion of the microwave radiation impinging upon a body to be converted into heat. The rate of heating is equal to the rate of energy abstraction from the impinging radiation and depends upon the degree of lossiness of the body. However, as will be more fully explained below, the dimensions may be so chosen that the "losses", or energy absorbed in watts per unit area may be the same as between the two regions of the susceptor, while the "lossiness" characteristic of each such region is different as between them. This lossiness can be considered as a function of the surface resistivity of a conductive layer, when such a layer is used to form the susceptor region in question, or as the equivalent resistivity when materials are used to form the susceptor region in which the energy is coupled into such region by means of magnetic or dielectric losses.

The invention seeks also to provide an improvement in the heating of the bulk of a body of food (or other material) with which the susceptor is in contact or closely associated.

In an embodiment of the invention, a susceptor may combine the two functions of (a) absorbing microwave energy to become heated itself and hence heat the food, e.g. for a browning or baking effect, and (b) generating or enhancing a modified field pattern, e.g. by formation of higher order modes of microwave energy in the body of the food with consequent improvements in the uniformity of the microwave heating of the food.

Higher order modes of microwave energy have different energy patterns. When the structure is such as to cause at least one higher order mode of microwave energy to exist in conjunction with the fundamental modes, i.e. normally (1,0) and (0,1) modes in a rectangular system, a more even heating can be obtained, since the total microwave energy is divided between the total number of modes. As a result, an arrangement that forces multi-mode propagation yields a foodstuff that is more evenly cooked. The term multi-mode in this application means a fundamental mode and at least one higher order mode. If, because of container geometry, or as a result of the nature of the material being heated, higher order modes already exist, the intensity of these modes may be increased.

The present invention can accomplish this multimode generation or amplification by means of a susceptor that changes the boundary conditions of the body of food or other material to be heated or of a container in which the food is held such that at least one higher order mode of microwave energy is forced to propagate.

In considering the heating effect of higher order modes which may or may not exist within the body of material, it is necessary to notionally subdivide the body into cells, the number and arrangement of these cells depending upon the particular higher order mode under consideration. Each of these cells behaves, from the point of view of microwave power distribution, as if it were itself a separate body of material and therefore exhibits a power distribution that is high around the edges of the cell, but low in the centre. Because of the physically small size of these cells, heat exchange between adjacent cells during cooking is improved and more even heating of the material results. However, in a normal container i.e. unmodified by the present invention, these higher order modes are either not present at all, or, if they are present, are not of sufficient strength to significantly heat the food. Thus the primary heating effect is due to the fundamental modes, resulting in a central cold area.

Recognising these problems, one of the objects of the present invention is to improve heating of this cold central area. This can be achieved in two ways:

1) in modifying the microwave field pattern by enhancing higher order modes which naturally exist anyway due to the boundary conditions set by the physical geometry of the body of material or of its container, but not at an intensity sufficient to yield a substantial heating effect, or, where such naturally higher order modes do not exist at all (due to the geometry), to cause propagation of such modes.

2) to superimpose or "force" onto the normal field pattern—which, as has been said, is primarily in a fundamental mode—a further higher order field pattern whose characteristics owe nothing to the geometry of the body of material or container and whose energy is directed towards the geometric centre in the horizontal plane, which is the area where the heating needs to be enhanced.

In both the above cases the net result is the same; the body of material can be notionally considered as having been divided into several smaller regions, each of which has a heating pattern similar to that of a fundamental mode, as described above. However, because the regions are now physically smaller, normal heat flow currents within the food have sufficient time, during the relatively short microwave cooking period, to evenly redistribute the heat and thus avoid cold areas. In practice, under certain conditions, higher order mode heating may take place due to both of the above mechanisms simultaneously.

In the present invention, the higher order modes can be generated or enhanced by employing a susceptor in which the discontinuity of lossiness is stepwise. This discontinuity then distrubs the microwave electric field, causing a stepwise variation of electric field intensity which in turn results in the generation or enhancement of the higher order mode or modes.

It should also be added that, while a stepwise discontinuity, in contrast to a gradual merging of one lossiness into another, is necessary in order to ensure production of the higher order mode or modes, in practice the manufacturing techniques available may result in there being some graduation of one lossiness into the other, rather than a perfect stepwise edge, and, provided this imperfection is small in comparison with the overall dimensions of the susceptor, it can be tolerated, and the term "stepwise discontinuity" is to be understood accordingly herein.

Microwave radiation incident upon the interface between two media will be reflected at this interface if the media have differing refractive indices or losses. The amount of reflection will depend on the magnitude of the differences in refractive indices and losses, as well as on the thickness of the "second" medium into which the radiation is directed. If this second medium is of infinitesimal thickness, then no reflection will occur, and propagation of the radiation will continue uninterrupted. As well, if the refractive indices and losses of the media are identical, then no reflection can occur at the interface. Refractive indices of the media will vary as the square-root of the product of their dielectric constants and magnetic permeabilities. The electrical thickness of the second medium will be proportional to its physical thickness divided by its refractive index.

A manner in which higher order modes can be generated or enhanced by a stepwise difference of electrical thickness between a modified surface region and one or more adjacent regions has been described in my U.S. patent application Ser. No. 943,563, filed Dec. 18, 1986 (now allowed; issue fee paid), and the adoption of a discontinuity of losses according to the present invention can be used in conjunction with such a stepwise difference of electrical thickness for the same purpose.

My earlier patent application just referred to, as well as my U.S. patent application Ser. No. 044,588, filed Apr. 30, 1987 (now U.S. Pat. No. 4,831,224), also discloses arrangements in which the higher order modes are generated or enhanced by a physical displacement of a modified surface region from adjacent surface regions, e.g. a stepped structure that protrudes either into the container or outwardly therefrom, and again the adoption of a discontinuity of losses according to the present invention can be used in conjunction with such a physical displacement for the same purpose.

Moreover, my U.S. patent application Ser. No. 878,171, filed June 25, 1986 (and U.S. patent application Ser. No. 142,259, filed Jan. 11, 1988, as a continuation thereof, now U.S. Pat. No. 4,866,234), discloses arrangements in which higher order modes are generated or enhanced by electrically conducting plates, or by metal sheets with apertures therein. Again, the adoption of a discontinuity of losses according to the present invention can be used in conjunction with such electrically conducting plates or apertured sheets.

To these ends the contents of all my prior patent applications referred to above are hereby incorporated herein by reference.

Multi-mode generation based on a stepwise discontinuity of lossiness can be formulated by considering regions of a surface, as in such other applications. Thus (3,3) mode generation can be promoted in a rectangular surface by subdividing it into equal "cells", each measuring one third of the length and width of the surface. Such multi-mode generation at the surface can lead to an improvement of heating uniformity at the surface, without there necessarily being a corresponding improvement in the uniformity of heating of the bulk of the material, as a result of the different transmissive properties of the stepwise discontinuous regions.

The metal plates or apertured sheets of application Ser. No. 878,171 are intended to derive electrical and structural integrity from the minimization of ohmic losses. Only at a few tens of angstroms in thickness will a metal film provide the desired transmission of radiation into adjacent food material while furnishing losses. The property of lossiness or power dissipation depends on the ability of electric fields to penetrate the film, so that power dissipated by the film will vary with the product of conductivity and the squared magnitude of the electric fields. While the conductivity of aluminium foil is high, electric field intensities are typically so low that power dissipation is negligible. Hence the metal plates or sheets of application Ser. No. 878,171 may or may not provide stepwise discontinuities of lossiness.

A susceptor according to the present invention can be near or adjacent to one or more surfaces of a food article. If the desired browning or crispening is to be obtained by direct transmission of heat to the food, then the susceptor should be in close contact with the food. If modification of food heating distributions is desired, along with a baking effect due to heating of an enclosed air space, then the susceptor can be separated from the food by an air gap, as would obtain from mounting it on a heat-resistant package of substantially larger volume than the contained food.

Variation of lossiness can be obtained by varying the thickness of a lossy deposit on a heat-resisting substrate, or by varying the volume-fraction of a lossy substance contained within a heat-resistant matrix, whether this lossy substance and matrix together comprise a coating applied in turn to a heat-resisting substrate, or instead comprise the entire thickness of the structure. As hereinbefore mentioned, regions of the surfaces over which these stepwise discontinuities occur can be defined as in our prior applications, with stepped regions being preferably rectangular for rectangular surfaces or food shapes, and round, annular, sectorial or sectorial-annular for round surfaces or food shapes. These discontinuities can thus have geometries that are dictated either by the overall geometry of the surface or by the food shape, and which are related to the surface geometry or food shape through the properties of similarity or conformality, or are based on common coordinate systems. The surfaces of the structures can also be contoured or of varying overall thickness, following the descriptions in our prior applications, so that inward or outward protrusions will also contribute to the modification of heating distribution within an adjacent food article. Alternatively, the surfaces of the structures can be contoured for aesthetic reasons, or for reasons related to desired cooking effects (e.g. slots provided for drainage or venting).

Lossy substances that can be incorporated in susceptors of this invention include, but are not limited to:

Thinly deposited metals (e.g. aluminium) or alloys (e.g. brasses or bronzes), applied in a substantially continuous layer in thicknesses typically of less than 150 Å;

Resistive or semi-conductive substances, with the former being exemplified by carbon black or graphitic deposits, and the latter by silicon, silicon carbide, and metal oxides and sulfides;

Lossy ferroelectrics, such as barium or strontium titanates;

Lossy ferromagnetics (e.g. iron or steel) or ferromagnetic alloys (stainless-steels);

Lossy ferrimagnetics, such as ferrites; and

Mixtures or dispersions or any of the foregoing in inert binders or matrices, as inks, paints, glazes, and the like.

Thin elemental deposits can be applied by ordinary vacuum-deposition, while magnetron-sputtering can be used in the application of alloys. Lossy ferromagnetics, ferrimagnetics and ferroelectrics can be chosen with Curie temperatures that provide a self-limitation of heating over a desired range of temperatures.

A particularly economic configuration for the present structures consists of stepwise discontinuous, lossy material, vacuum-deposited or sputtered onto a temperature-resisting plastic film, and bonded with heat-resistant adhesive to a paperboard support. Stepwise varying deposits can be formed by two-pass or two station vacuum-deposition or sputtering, entailing the formation of a uniform layer in a first step, followed by the use of masking to obtain stepped regions. Alternatively, stepwise discontinuous, lossy deposits can be obtained by the printing of not necessarily identical, lossy inks. Stepwise discontinuous, screen-printed glazes can be used in the manufacture of ceramic permanent cookware.

In order that the invention may be better understood, some embodiments thereof will now be described by way of example only and with reference to the accompanying drawings in which.

Figure 1:
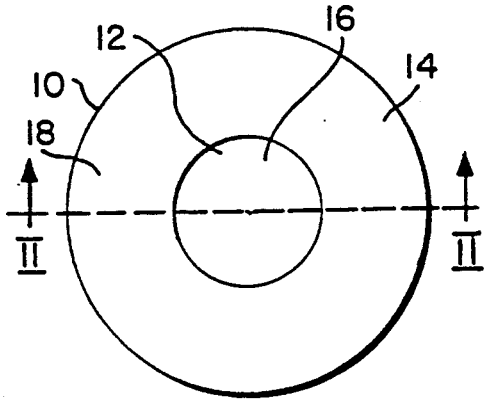
FIG. 1 is a plan view of a susceptor which may be part of a microwave container or a wall component or lid therefor.
Figure 6:
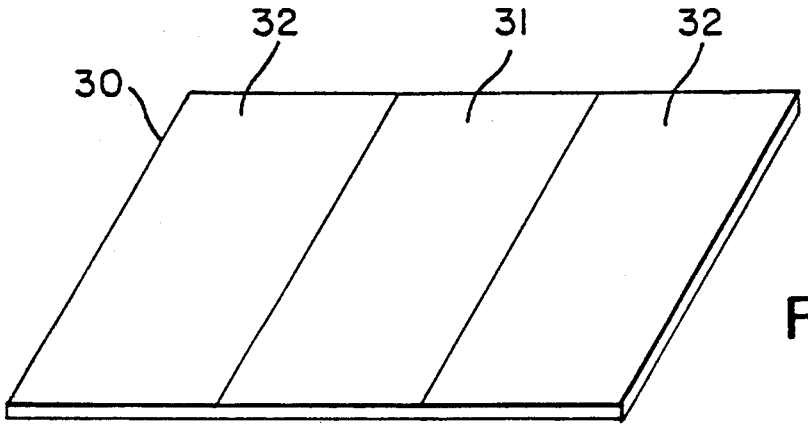
Figure 7:
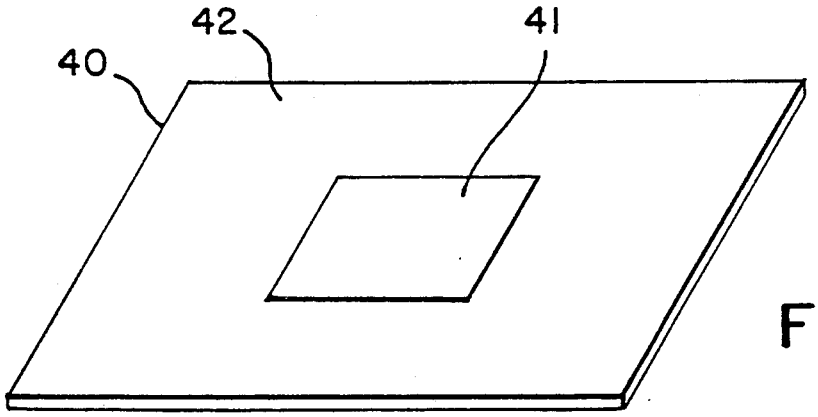
Figure 8:
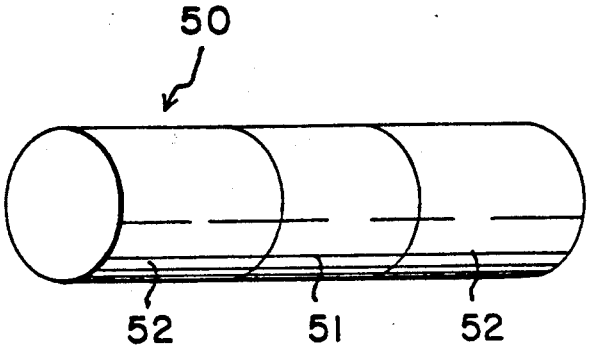
Figure 9:
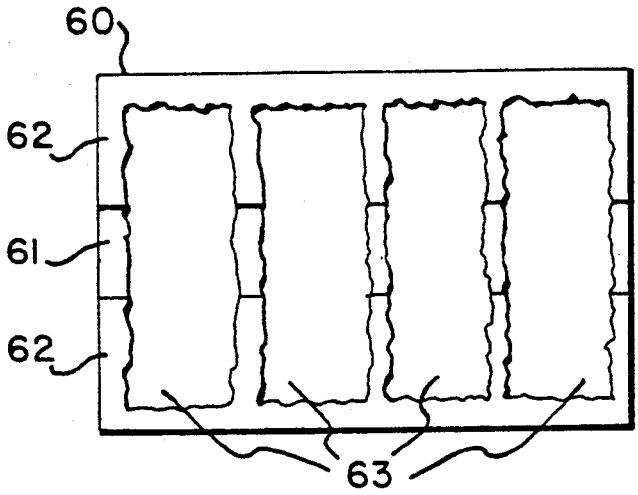
Figure 10:
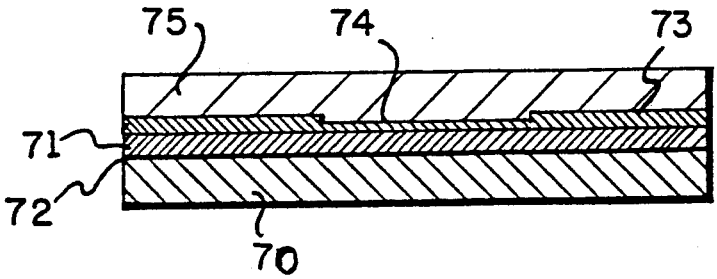
Figure 11:
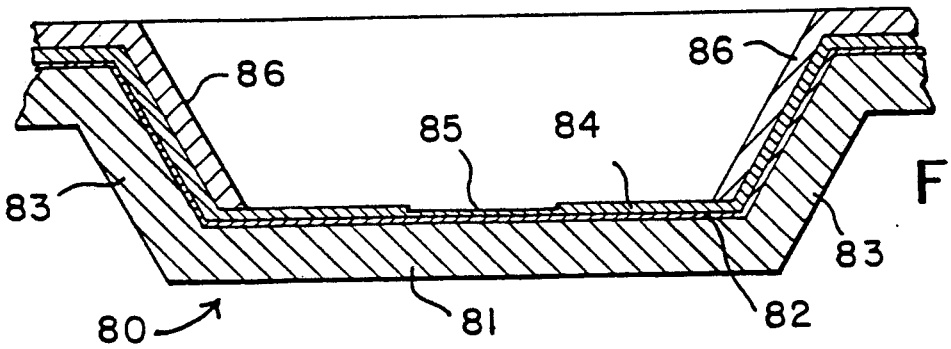
Figure 12:
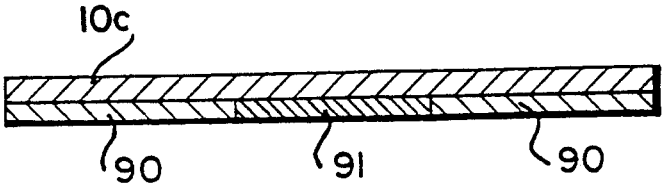

FIGS. 6 to 8 each show a variant of FIG. 1;

FIG. 9 demonstrates another practical use of an embodiment of the invention; and FIGS. 10 to 12 are cross-sections demonstrating other embodiments of the invention.

Figure 2:
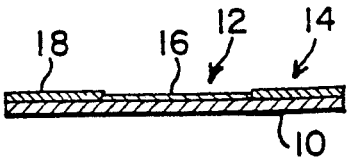
FIG. 2 is a section on II—II in FIG. 1.

FIGS. 1 and 2 show a susceptor in the form of a panel 10, e.g. the bottom panel of a circular container for food or other body of material to be heated in a microwave oven, such panel being divided into a central circular region 12 and a peripheral, annular region 14. These regions differ from each other in their degree of lossiness. This difference can be obtained by the deposition on both regions of lossy, e.g. aluminium, coatings 16 and 18 that differ in thickness, as shown on an exaggerated scale in FIGS. 2 or 3. FIG. 2 shows the coating 16 on the central region 12 as thinner than the coating 18 on the peripheral region 14. This difference can be reversed by making the peripheral coating 18 thinner, as shown in FIG. 3.

The energy absorbed in such a coating will vary with thickness. For example, extremely thin aluminium coatings, e.g. 50 Å, absorbs microwave energy, but are also semi-microwave-transparent, allowing some transmission of microwave energy into an adjacent material to be heated. When energy reflected from these coatings destructively interferes with energy reflected from the adjacent material improved coupling of microwave energy into this material may result. Since these thin coatings transmit microwave energy, they are penetrated by non-vanishing electric fields, and the power dissipated by them is determined by the product of their conductivity with the squared magnitude of these electric fields, or alternatively, by the product of electric fields and induced current intensities within them. As coating thicknesses are increased to intermediate values, e.g. 100 Å, electric fields within the coatings will decrease, while induced current intensities will increase. When the product of these lowered electric fields and increased current intensities equals the product of electric fields and current intensities occurring within the thin coatings, similar heating will be obtainable from these two different thicknesses. However, for thicker aluminium coatings, e.g. 150 Å, the decrease of penetrating electric fields will no longer be counterbalanced by increased current intensities, and less intense heating will result. At these greater thicknesses, the coatings tend to be reflective, providing minimal transmittance of microwave energy through them, to an adjacent material to be heated. Materials having different resistivities or lossiness, e.g. carbon, will require different thicknesses to achieve similar results.

It will be possible to choose two different thicknesses for the respective coatings 16, 18 that will be such as to cause them to be heated to substantially the same temperature so as to provide a uniform browning effect when in contact with a body of food, or a uniform baking effect if spaced from the food. If a thinner coating is chosen for the inner coating 16 (FIG. 2) and a thicker coating is chosen for the outer coating 18, the inner coating 16 will be more transmissive of the microwave energy than the outer coating 18. Hence, while the browning or baking effect may be uniform due to the absorbed energy being the same or substantially the same, the amount of microwave energy entering the bulk of the body of food will be increased in the central region of the food, which is desirable for achieving a more uniform internal heating of the food. The reverse effect is achieved with the embodiment of FIG. 3, namely a more disuniform heating in the bulk of the food. Alternatively, the coating thicknesses can be so chosen that there will be little or no change to the bulk heating effect.

Figure 3:
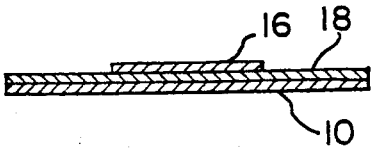
FIG. 3 is a variant of FIG. 2.
Figure 5:
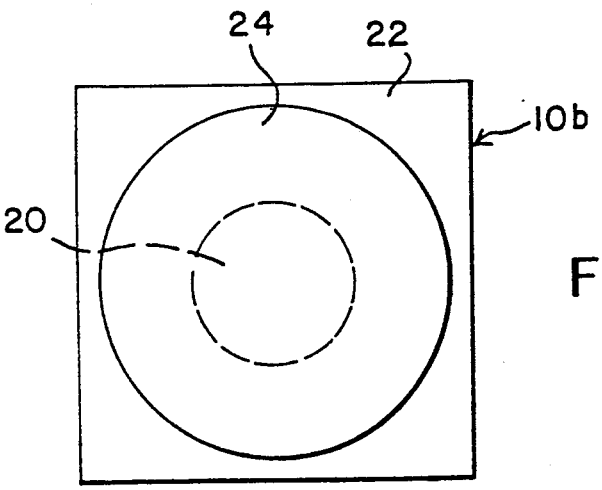
FIG. 5 shows the structure of FIG. 4 when loaded with a body to be heated.
Figure 4:
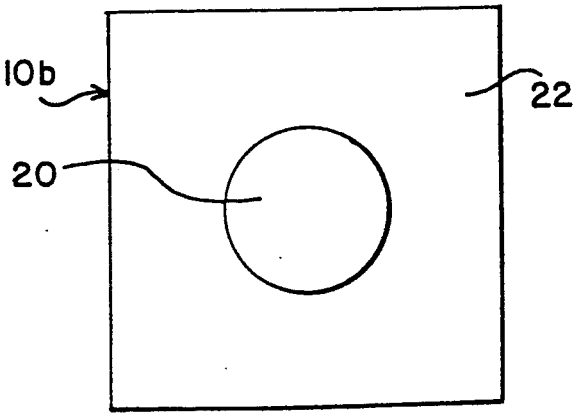
FIG. 4 shows a variant of FIG. 1.

FIGS. 4 and 5 show a variation of FIGS. 1 to 3 wherein the stepwise variation of losses is dictated by the food cross-section. The inner region 20 of a square panel 10*b* will have one inherent lossiness, e.g. one thickness, while the outer region 22 will have another inherent lossiness, e.g. another thickness. As before, either can be greater than the other. A circular body of food 24 forms an intermediate annular region that provides a further stepwise contrast to the losses of regions 20 and 22.

FIGS. 6 and 7 respectively show rectangular container surfaces 30 and 40 having regions 31 and 41 with one lossiness and region 32 and 42 with a different lossiness, such variations being obtained from differences of the thickness as before, or from the lossy nature of the material of the surface itself, or from coatings of different thickness or of a different lossy nature. The surface 30, in which the region 31 takes the form of a strip, favours the generation or enhancement of (3,N) modes, while the surface 40, in which the region 41 takes the form of an island, favours the generation or enhancement of the (3,3) mode.

FIG. 8 shows the concept of the present invention applied to a cylindrical container 50, e.g. for containing a croissant or other food product conveniently so shaped. The container 50 has a central, circumferential strip 51, and end, circumferential strips 52 respectively having different lossinesses, as before.

FIG. 9 shows a practical application of the basic arrangement of FIG. 6 with a surface 60 having a central strip 61 with a different lossiness from outer strips 62 for the purpose of enhancing the heating of the central regions of a row of food articles 63, e.g. fish sticks.

FIG. 10 shows a cross-section on an enlarged and exaggerated scale of a paperboard substrate 70 on which a thin heat resistant plastic film 71 is secured by an adhesive 72. The film 71 supports a peripheral lossy deposit 73 in a central region of which there is a second, thinner lossy deposit 74 in the same manner as FIG. 2. A protective layer 75, suitable for contacting the food or other material to be heated, overlays the deposits 73, 74.

FIG. 11 shows a container 80 with a substrate 81, a first, relatively thin deposit 82 that extends across the bottom and up sloping side walls 83 of the container, a second, thicker deposit 84 that covers the first deposit over the bottom and side wall surfaces except for a central thinner deposit 85, and a third, still thicker deposit 86 that covers only the side wall regions of the deposit 84. A protective layer (not shown) can be used if needed.

The coating thickness (or the inherent lossiness) of the deposits 73,74 and 82,84,85 and 86 can vary in any desired stepwise respect. It should also be made clear that stepwise discontinuities can be obtained from a single substance, or from a combination of materials (e.g. one being lossy in a conductivity sense, and the other in a magnetic and conductivity sense). FIG. 12 illustrates such an embodiment of the invention, wherein a panel 10*c* has applied to its coatings 90 and 91 of the same thickness but having different lossiness by virtue of a difference in the volume-fraction of a lossy substance in a heat-resistant matrix.

While multi-mode generation may be obtained or enhanced by a stepwise discontinuity of lossiness, the primary function of a susceptor according to the present invention resides in providing more uniform heat distribution, or other desired heat distribution for browning, crispening or baking one or more food surfaces.

The stepwise discontinuity of lossiness need not affect the electrical thickness of the structures, although a proportionality may exist between the dielectric and the magnetic losses, and the dielectric constants and magnetic permeability, respectively.

The following tests have been carried out. On a film of metallizable polyester, the respective regions were coated by sputtering with high purity aluminium. These regions were either "thin" (50 Å±5%) or "thick" (100 Å±5%). The coated polyester film was then adhesively bonded to a paperboard base. As explained above the "thick" coating was more lossy than the "thin" coating, but both had substantial lossiness.

In each of the tests a mixture of 50% water and 50% "Cream of Wheat"* (Manufactured by Nabisco Brands Ltd.) was used as the load. In the tests on circular structures (tests 1–4) the load weighed 60 gms; in the tests on square structure (tests 5 and 6) the load weighed 150 gms.

* Trade Mark

Test "1" compared three susceptors "A", "B" and "C1". Susceptor "A" was a 10 cm circular, commercially obtained susceptor with a lossy material distributed evenly across its surface. Susceptor "B" was a similar 10 cm circular susceptor prepared specifically for these tests, but also made in accordance with the prior art, namely with a "thick" aluminium coating of 100 Å sputtered uniformly across its surface. Susceptor "C1" was a susceptor made according to the present invention, i.e. a circular structure of overall 10 cm diameter, having a "thick" coating on a central circular region of 4 cm diameter, and a "thin" coating forming an annulus around the central region (as per FIG. 3). The load was spread over the entire 10 cm surface of all three susceptors to a depth of about 2½ mm. Each of the assemblies thus produced was heated for 30 seconds in a "Kenmore"* 700 watt microwave oven, manufactured by Sanyo Industries Company, Inc. The temperature-rise "T" was measured in the centre of each assembly at the interface between the susceptor and the load. The measured values for "T" were "A", 34° C.; "B", 36° C.; and "C1", 54° C.

In test "2", a similar comparison was made except that this time the third susceptor "C2" had the thin and thick coatings interchanged, i.e. with the thick coating forming the annulus as shown in FIG. 2. The value of "T" for "C2" was found to be 51° C.

Tests "3" and "4" corresponded respectively to tests "1" and "2", except that in tests "3" and "4" the diameter of the central region was increased from 4 cm to 7 cm. The values of "T" for "C3" and "C4" were found to be respectively 63° C. and 55° C.

Tests "5" and "6" were conducted using a square annulus of 15 cm side length surrounding a central square region with a 5 cm side length. Test "5" corresponded to tests "1" and "3", in that the thick coating formed the square central region and the thin coating formed the square annulus; while test "6" corresponded to tests "2" and "4", in that the coating thicknesses were reversed. A control (prior art) square sample "B'", was the same size and shape as Samples "C5" and "C6", but had a uniform 100 Å aluminium coating. Heating was for 40 seconds in the same oven. The measured values of "T" were "B'", 15° C.; "C5", 30° C.; and "C6", 27° C.

In all the susceptors according to the invention, namely "C1" to "C6", the different thickness regions were contiguous with each other. The substantially higher temperature-rises "T" found at the centres of the food samples when using susceptors "C1" to "C6" (compared with the control susceptors, "A", "B" and "B'"), even when the lossier regions (the thick regions) formed the annulus, were believed to result from the stepwise discontinuity between the regions of different lossiness having served to generate or enhance a modified microwave field pattern, namely the formation of higher order modes of microwave energy in the body of the food, with consequent improvement in the uniformity of heating of the food. In other words, the traditionally observed cold spots in the centres of the samples were largely eliminated or at least significantly reduced.

I claim:

1. A system for enhancing the uniformity of heating of a body of material within a microwave oven, said system comprising a body of material to be heated by microwave energy and a susceptor positioned near to or adjacent said body to transfer to the body heat generated in the susceptor, said susceptor comprising a panel having at least two regions of a lossy substance, each such region being adapted to couple with and absorb microwave energy to generate heat, one such region having a different lossiness from the other such region and the regions being contiguous with each other whereby to provide a stepwise discontinuity of lossiness between them, said body being positioned with respect to said susceptor to receive heat from it and to extend across the discontinuity, said discontinuity serving with the body to generate or enhance in the body a modified microwave field pattern whereby to enhance the uniformity of overall heating of the body by the combined effect of the susceptor and the microwave energy converted to heat in the body.

2. The system as claimed in claim 1, wherein the body of material is a foodstuff and the susceptor is in contact with a surface of the foodstuff to achieve a browning or crispening effect at said surface.

3. The system as claimed in claim 1, wherein the body of material is a foodstuff and the susceptor is spaced from a surface of the foodstuff with an air space between them to achieve a baking effect on the foodstuff.

4. The system as claimed in claim 1, wherein said susceptor regions have different transmittance characteristics for microwave energy from each other whereby to favour entry of said energy into selected regions of the body of material.

5. A system as claimed in claim 1, wherein said regions include means for coupling with the microwave energy by generating conductivity losses in such regions.

6. A system as claimed in claim 1, wherein said regions include means for coupling with the microwave energy by generating dielectric losses in such regions.

7. A system as claimed in claim 1, wherein said regions include means for coupling with the microwave energy by generating magnetic losses in such regions.

8. A system as claimed in claim 1, wherein said regions include lossy coatings of different thicknesses or of different inherent lossiness.

9. A system as claimed in claim 1, wherein the respective regions each have different inherent lossiness.

10. A system as claimed in claim 9, wherein the respective regions each comprise a matrix each with a different volume-fraction of a lossy substance in the matrix.

11. A system as claimed in claim 1, wherein said lossy substances are selected from (a) thinly deposited metals,
(b) resistive substances,
(c) semi-conductive substances,
(d) lossy ferroelectrics,
(e) lossy ferromagnetics,
(f) lossy ferrimagnetics, and
(g) mixtures of the foregoing.

12. A system of claim 11, wherein a said thinly deposited metal is applied in a layer of thickness of about 150 Å or less.

13. A system of claim 11, wherein a said resistive substance is selected from carbon black or a graphitic deposit.

14. A system of claim 11, wherein a said semi-conductive substance is selected from silicon, silicon carbide, metal oxides and metal sulphides.

15. A system of claim 11, wherein a said lossy ferroelectric contains a titanate of barium or strontium.

16. A system of claim 11, wherein a said lossy ferromagnetic is selected from iron, steel and other iron alloys.

17. A system of claim 11, wherein a lossy ferrimagnetic is a ferrite.

18. A system of claim 1, wherein said one region also differs from said other region in electrical thickness.

19. A system of claim 1, wherein said one region also differs from said other region by a physical displacement from the surface of the susceptor.

20. A system according to claim 1, wherein one said region forms an annulus contiguously surrounding the other region.

21. A system according to claim 1, wherein one said region is formed of a coating of aluminum of a thickness of approximately 50 Å, and the other region is formed of a thickness of approximately 100 Å.

22. A method of enhancing the uniformity of heating within a body of material being heated within a microwave oven, said method comprising placing said body near to or adjacent a susceptor to transfer heat generated in the susceptor to the body, said susceptor comprising a panel having at least two regions of a lossy substance, one such region having a different lossiness to microwave radiation from the other such region, said two regions being contiguous with one another to provide a stepwise discontinuity of lossiness between them, said body being positioned to extend across the discontinuity, said method further comprising subjecting the body and the susceptor to microwave energy to cause the two regions of the susceptor to couple with and absorb microwave energy to different degrees and to cause the body and the stepwise discontinuity in the susceptor to act together to generate or enhance a modified microwave field pattern within the body, whereby to enhance the uniformity of overall heating of the body by the combined effect of the susceptor and the microwave energy converted to heat in the body.

23. A method according to claim 22, wherein said susceptor is formed in a wall component of a container in which the body is mounted, and wherein the step of subjecting the body and the susceptor to microwave energy comprises irradiating the container with the body therein.

24. A system for enhancing the uniformity of heating of a body of material within a microwave oven, said system comprising a body of material to be heated by microwave energy and a susceptor positioned near to or adjacent said body to transfer heat generated in the susceptor to the body, said susceptor comprising a panel having at least two regions of a lossy substance adapted to couple with and absorb microwave energy to generate heat, the regions being contiguous with each other and providing a stepwise discontinuity between them, said body being positioned with respect to said susceptor so as to receive heat from it and to extend across the discontinuity, said discontinuity serving with the body to generate or enhance in the body a modified microwave field pattern, and the regions of the susceptor differing from each other in the energy they transmit to the body whereby to enhance the uniformity of overall heating of the body by the combined effect of the susceptor and the microwave energy converted to heat in the body.

25. A system according to claim 24, wherein the regions differ from each other in the energy they transmit to the body by virtue of the regions having different lossiness from each other.

26. A system according to claim 24, wherein the regions differ from each other in the energy they transmit to the body by virtue of the regions having different transmissibility of microwave energy from each other.

27. A method of enhancing the uniformity of heating within a body of material being heated within a microwave oven, said method comprising placing said body near to or adjacent a susceptor to transfer heat generated in the susceptor to the body, said susceptor comprising a panel having at least two regions of a lossy substance, said regions being contiguous with one another to provide a stepwise discontinuity between them, said body being positioned to extend across the discontinuity, said method further comprising subjecting the body and the susceptor to microwave energy to cause the two regions of the susceptor to transmit energy to the body to different degrees and to cause the body and the stepwise discontinuity in the susceptor to act together to generate or enhance a modified microwave field pattern within the body, whereby to enhance the uniformity of overall heating of the body by the combined effect of the susceptor and the microwave energy converted to heat in the body.

28. A method according to claim 27, wherein the regions differ from each other in the energy they transmit to the body by virtue of the regions having different lossiness from each other.

29. A method according to claim 27, wherein the regions differ from each other in the energy they transmit to the body by virtue of the regions having different transmissibility of microwave energy from each other.

* * * * *